US006389769B1

(12) United States Patent
McKinney et al.

(10) Patent No.: US 6,389,769 B1
(45) Date of Patent: May 21, 2002

(54) DOOR AND METHOD OF MAKING SAME

(75) Inventors: Matthew M. McKinney, Somerville; Robert L. LaFontaine, Houston; James D. Surber, Somerville, all of AL (US)

(73) Assignee: EFP Corporation, Decatur, AL (US)

( * ) Notice: Subject to any disclaimer, the term of this patent is extended or adjusted under 35 U.S.C. 154(b) by 0 days.

(21) Appl. No.: 09/610,258

(22) Filed: Jul. 5, 2000

(51) Int. Cl.[7] ..... E04C 1/00

(52) U.S. Cl. ..... 52/309.9; 52/309.4; 52/455; 52/473; 156/78

(58) Field of Search ..... 49/404; 52/309.11, 52/455, 19, 784.1, 784.15, 802.1, 802.11, 784.11, 309.9, 309.4, 620

(56) References Cited

U.S. PATENT DOCUMENTS

| | | | | | |
|---|---|---|---|---|---|
| 640,811 | A | * | 1/1900 | Reynolds | |
| 1,153,306 | A | * | 9/1915 | Hegstedt | |
| 2,023,661 | A | * | 12/1935 | Beyrle | 20/35 |
| 2,692,664 | A | * | 10/1954 | Ternes | 189/46 |
| 3,121,264 | A | * | 2/1964 | Hammar | 20/35 |
| 3,334,464 | A | * | 8/1967 | Charles | 52/620 |
| 3,585,770 | A | | 6/1971 | Maizler | |
| 3,832,805 | A | | 9/1974 | Stevens | |
| 4,087,942 | A | | 5/1978 | Herrmann | |
| 4,148,157 | A | | 4/1979 | Franc | |
| 4,152,876 | A | | 5/1979 | Seely | |
| 4,154,034 | A | * | 5/1979 | Bursk et al. | 52/213 |
| 4,295,299 | A | | 10/1981 | Nelson | |
| 4,550,540 | A | | 11/1985 | Thorn | |
| 4,702,054 | A | | 10/1987 | Turner | |
| 4,949,771 | A | | 8/1990 | Grisham et al. | |
| 5,417,024 | A | | 5/1995 | San Paolo | |
| 5,533,312 | A | * | 7/1996 | Mihalcheon | 52/309.9 |
| 5,577,363 | A | * | 11/1996 | Tate et al. | 52/784.15 |
| 5,613,324 | A | | 3/1997 | Theune | |
| 5,619,823 | A | | 4/1997 | Ruff et al. | |
| 5,782,052 | A | * | 7/1998 | Lacy | 52/47 |
| 5,839,252 | A | * | 11/1998 | Berghorn et al. | 52/84.13 |
| 5,853,512 | A | * | 12/1998 | McKinney | 156/78 |
| 6,112,496 | A | * | 9/2000 | Hugus et al. | 52/309.9 |

* cited by examiner

*Primary Examiner*—Carl D. Friedman
*Assistant Examiner*—Basil Katcheves
(74) *Attorney, Agent, or Firm*—Waddey&Patterson, P.C.; John C. Garvin, Jr.

(57) ABSTRACT

A door and method for fabrication of unitary six panel steel doors wherein frames members (stiles and rails or headers) are fabricated by forming metal stock into a cross-sectional channel configuration, cutting and swaging the channels into predetermined lengths. The stiles and rails of the frame members are swaged to provide frictional interconnection at the corners thereof upon assembly of the frame members (stiles and rails) into a rectangular frame configuration. Assembly of the frame is accomplished in a shuttle having two assembly jigs. Upon assembly, each frame is moved by the shuttle into a molding press wherein a panel of foam is molded within the frame. The shuttle moves back and forth through the molding press in a manner which provides for removal of a completed panel and assembly of an additional frame from one jig of the shuttle while the molding operation is accomplished within the molding press upon a frame retained within the other jig of the shuttle. Steel skins are secured to each side of the six panel steel doors leaving a border in the order of one-eighth inch (⅛") on each face of the door.

17 Claims, 14 Drawing Sheets

DOOR AND METHOD OF MAKING SAME

TECHNICAL FIELD OF THE INVENTION

This invention relates to a door and method of manufacturing same, and more particularly to an exterior steel door that is inherently stronger and improved in that it is less susceptible to water absorption and deformation due to its specific construction and manufacturing process.

BACKGROUND OF THE INVENTION

Steel doors are generally constructed with steel sheeting covering each side of a frame made of wood or metal. The four surrounding frame members (stiles and rails) are normally made of wood, but sometimes steel. The wood stiles and rails are exposed on perimeter sides allowing environmental elements such as rain, snow, etc. to deteriorate the door and the door finish. Other problems of manufacture and cost arise when trying to position two perimeter stiles and two perimeter rails that have to be dimensionally accurate in length, width, and diagonal while attaching the embossed steel skin on a frame assembly.

There are several U.S. patents which disclose prior art steel doors, with the following U.S. patents being exemplary of such doors: U.S. Pat. No. 4,148,157 to Franc; U.S. Pat. No. 4,152,876 to Seely; and U.S. Pat. No. 4,550,540 to Thorn. The patent to Franc (U.S. Pat. No. 4,148,157) discloses a metal clad door including an internal metal frame, two external panels of metal on each side of the frame, a sheet of insulating material such as foam filling a space defined by the frame and the two external panels, and a wooden edging surrounding the external panels to provide easy fitting and adjustment by the planing of the wooden edges. The patent to Seely (U.S. Pat. No. 4,152,876) discloses a metal faced door including a wooden frame, a cavity defined by the wooden frame, a foam core within the cavity, and a pair of metal panels adhered to the foam core and wooden frame, with the wooden frame being adaptable for trimming for fitting purposes. The patent to Thorn (U.S. Pat. No. 4,550,540) discloses a compression molded door comprising a rectangular perimeter frame made of wood, a foam core positioned within the rectangular perimeter frame, and a pair of skins or panels adhered to the sides of the foam core with the wood perimeter frame being adapted for trimming for fitting purposes.

The prior art also consists of U.S. Pat. No. 5,853,512 to McKinney and which is assigned to the Assignee of the instant invention. The McKinney patent discloses a method of fabricating unitary framed foam panels wherein frame members are fabricated by forming metal stock into a cross-sectional channel configuration, cutting and swaging the channels into predetermined lengths to provide frictional interconnection at the corners thereof upon assembly of the frame members into a rectangular frame configuration, and molding a foam panel within the rectangular frame. The framed foam panel disclosed by McKinney has some characteristics similar to the characteristics of the framed foam panel incorporated in the present invention.

SUMMARY OF THE INVENTION

The present invention relates to a rectangular door and method of manufacturing same. The door is generally comprised of a steel-framed foam core assembly and a pair of skins or coverings. The steel-framed foam core assembly generally comprises a pair of vertical stiles and a pair of horizontal rails or headers. Each stile and each rail has a swaged end and an unswaged end with the swaged end of each stile being joined to the unswaged end of an adjacent rail and the swaged end of each rail being joined to the unswaged end of an adjacent stile to provide a generally rectangular frame for supporting a foam core. The foam core includes one or more inserts for providing reinforcement to the door where hardware, such as knobs, locks and hinges, might be mounted to the finished door. The skins or coverings are preferably made of metal or a rigid plastic which are secured to the outer faces of the steel-framed foam core assembly to expose approximately one-eighth inch (⅛") of the two stiles and two rails to provide a border around the periphery of the steel-framed foam core assembly. The steel frame, foam core, and the skins combine to provide a unitary door of exceptional rigidity and strength and are designed for rapid and economical assembly when employing the unique method of manufacturing the steel door of the present invention.

Accordingly, it is an object of the present invention to provide an improved door which can be assembled rapidly and economically from readily available components.

It is a further object of the present invention to provide an improved door including stiles and headers pre-cut to predetermined sizes, each having swaged and unswaged ends, joined together to form a frame core assembly to be filled with molded foam and having skins applied to the outer faces of the steel frame core assembly.

It is still a further object of the present invention to provide an exceptionally rigid and sturdy door designed for rapid and economical assembly.

These and other objects and advantages of the present invention will become more readily apparent from the following detailed description when taken in conjunction with the accompanying drawings, specification, and claims.

DESCRIPTION OF THE PREFERRED EMBODIMENTS

Figure 1:
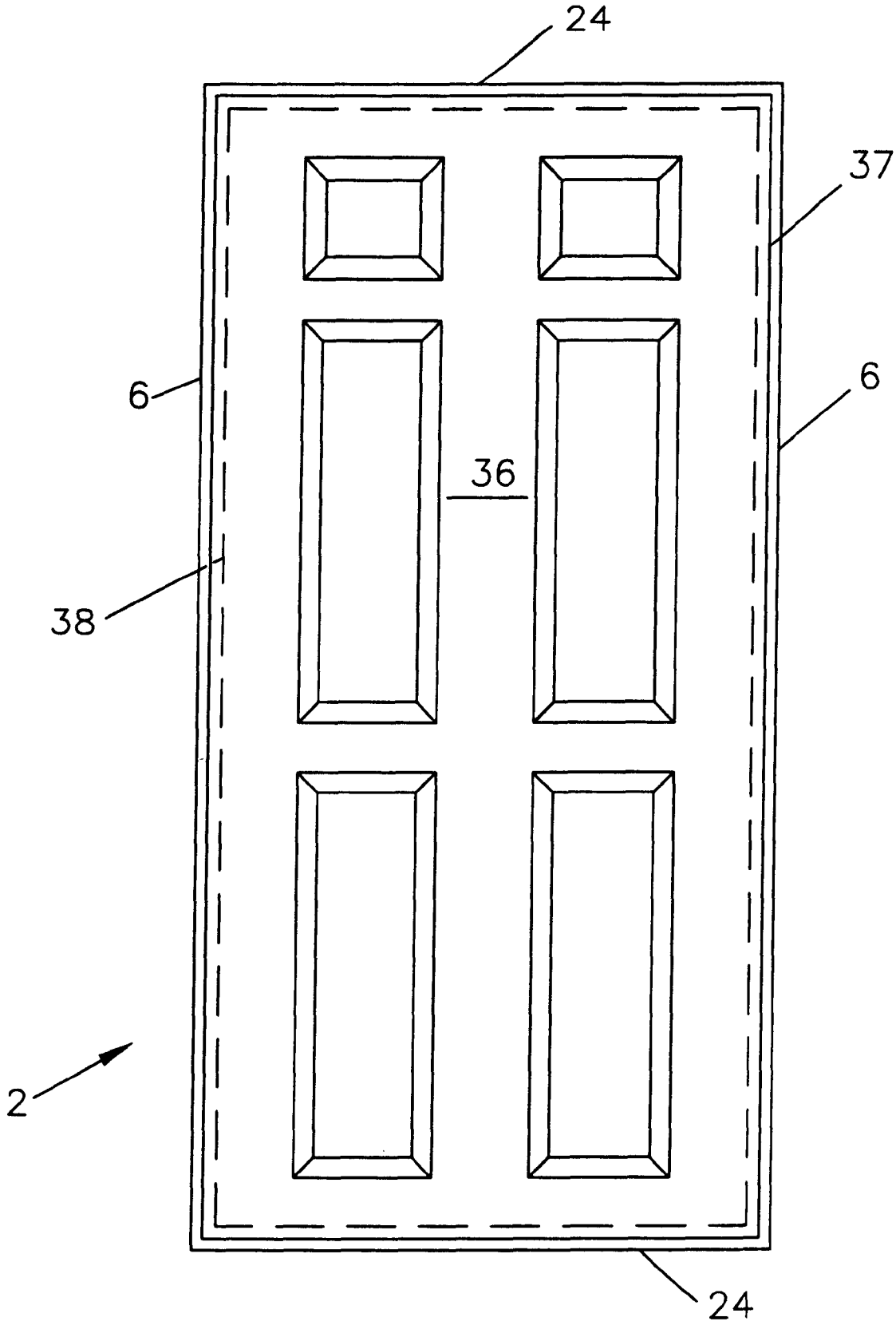
FIG. 1 is a front elevational view of the first embodiment of a six panel door of the present invention.

Throughout the description of the several embodiments which follows, like reference numerals will normally be used to indicate the same parts.

Figure 2:
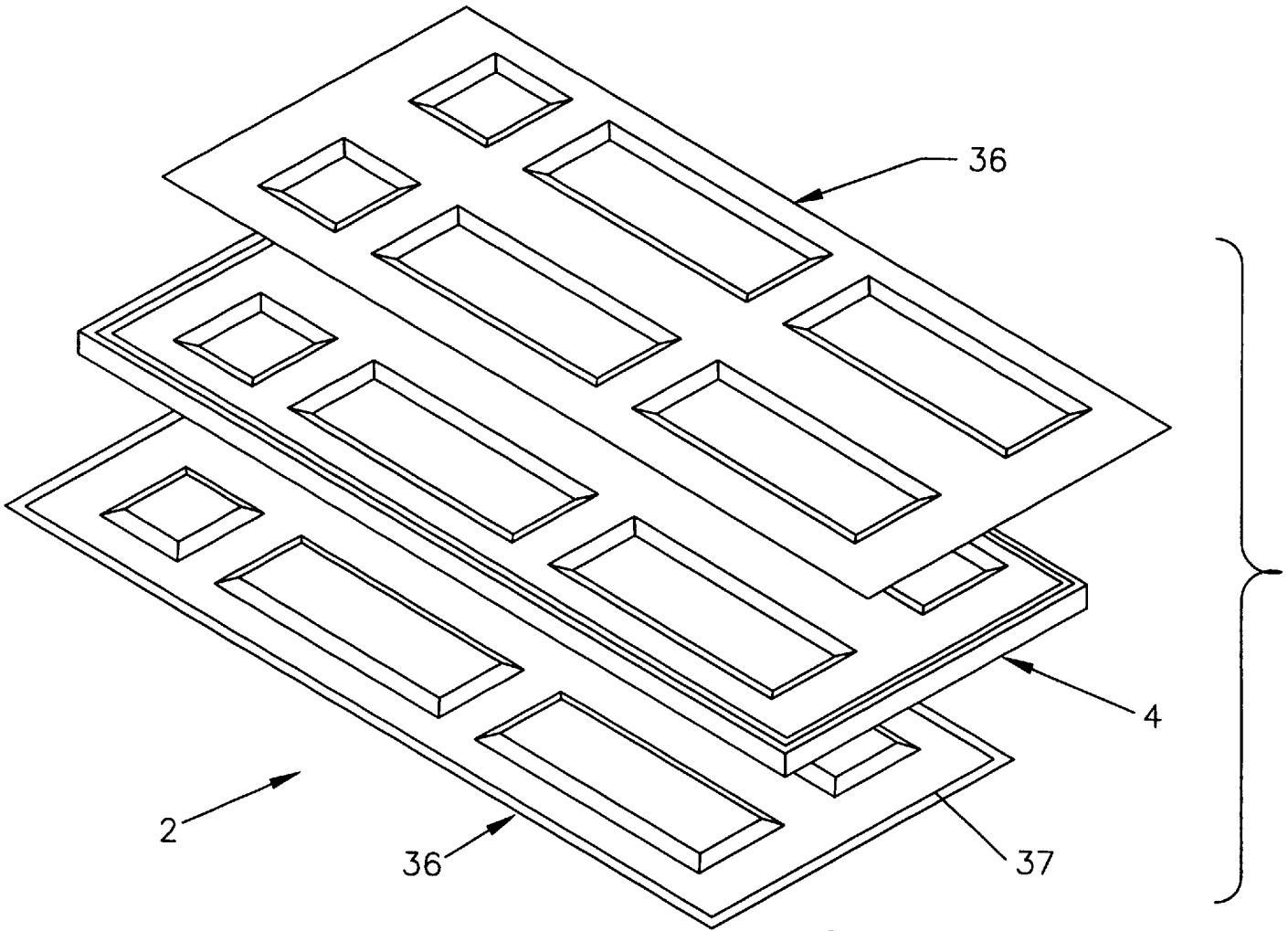
FIG. 2 is an exploded, perspective, view of the first embodiment of the six panel door of the present invention.

Referring now to the drawings, particularly FIGS. 1 and 2 thereof, reference numeral 2 generally designates the first embodiment of the door of the present invention. As best seen in FIG. 2, door 2 generally comprises a steel-framed foam core assembly 4, and a pair of skins or coverings 36.

Figure 3:
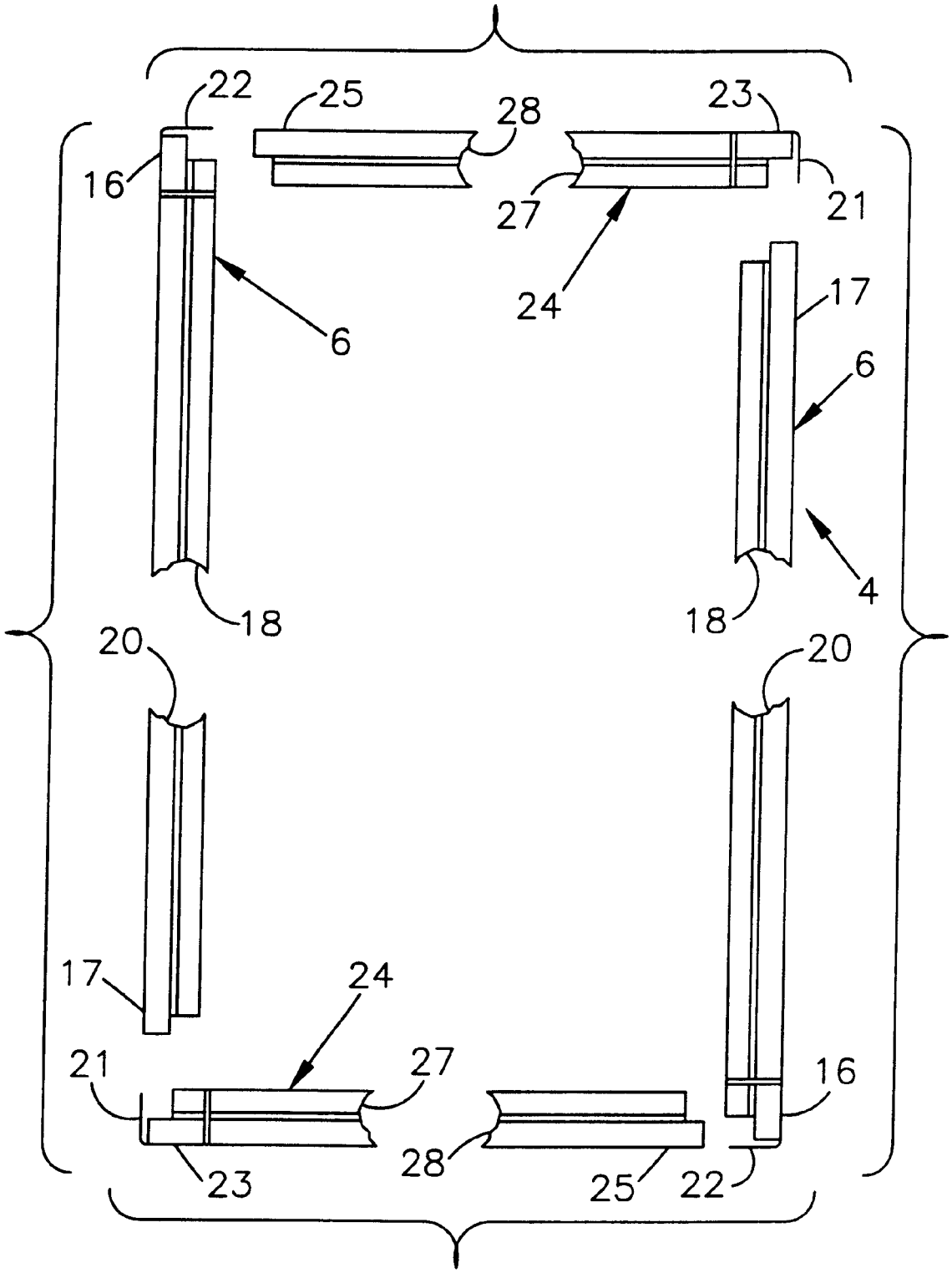
FIG. 3 is a front elevational, exploded, partially broken away, view of the two rails or headers and two stiles for incorporation into the first embodiment of the door of the present invention.
Figure 4:
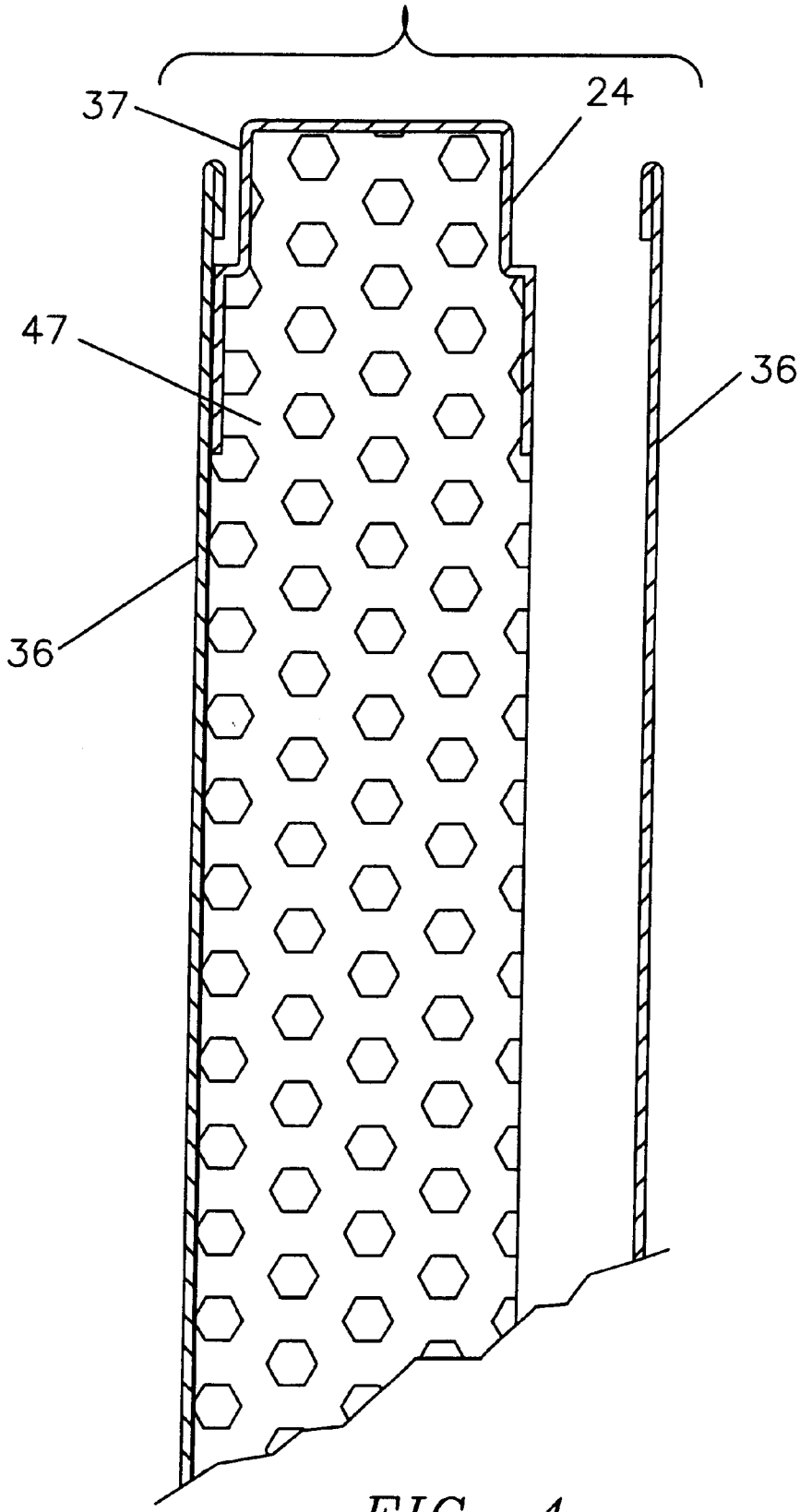
FIG. 4 is an exploded, partially broken-away, cross-sectional, view showing the details of one rail, the foam core, and the two skins of the first embodiment of the six panel door of the present invention depicting the first skin secured to one rail and the foam core and the second skin in spaced relationship thereto.
Figure 5:
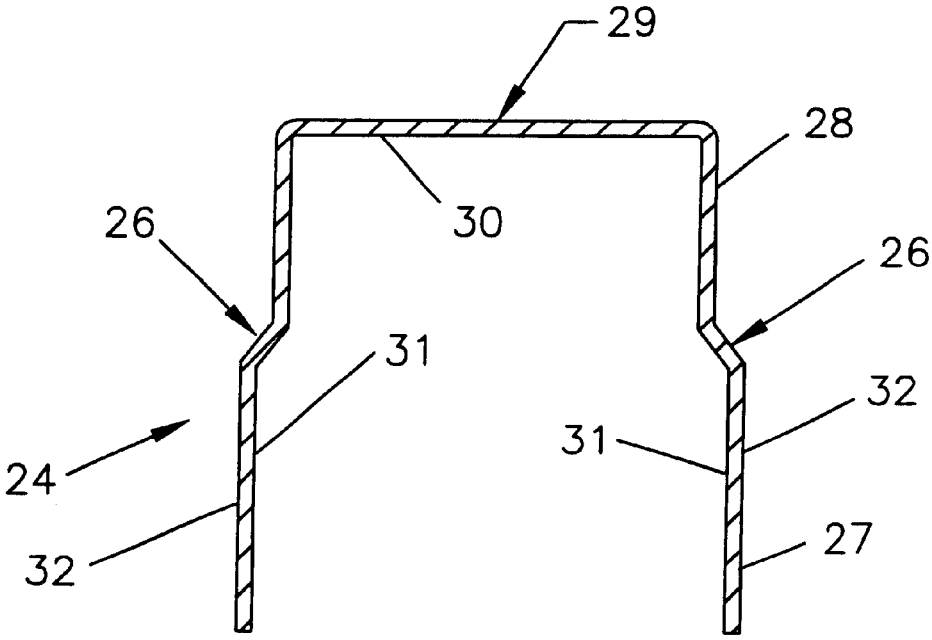
FIG. 5 is a cross-sectional view of a rail for the steel frame of the foam core assembly incorporated in the first embodiment of the six panel door of the present invention.
Figure 6:
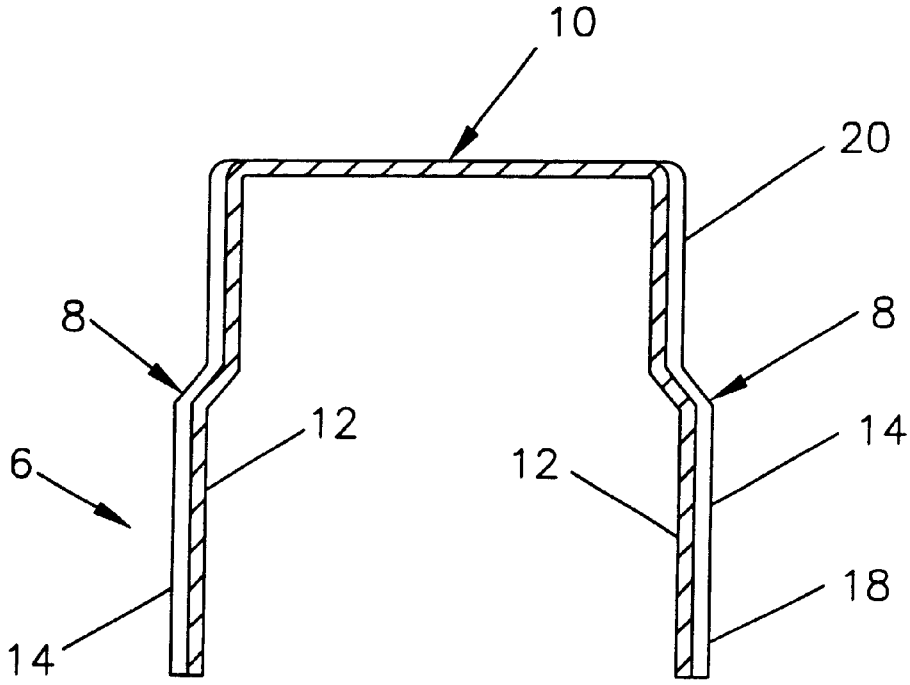
FIG. 6 is a cross-sectional view of a stile for the steel frame of the foam core assembly incorporated in the first embodiment of the six panel door of the present invention.
Figure 7:
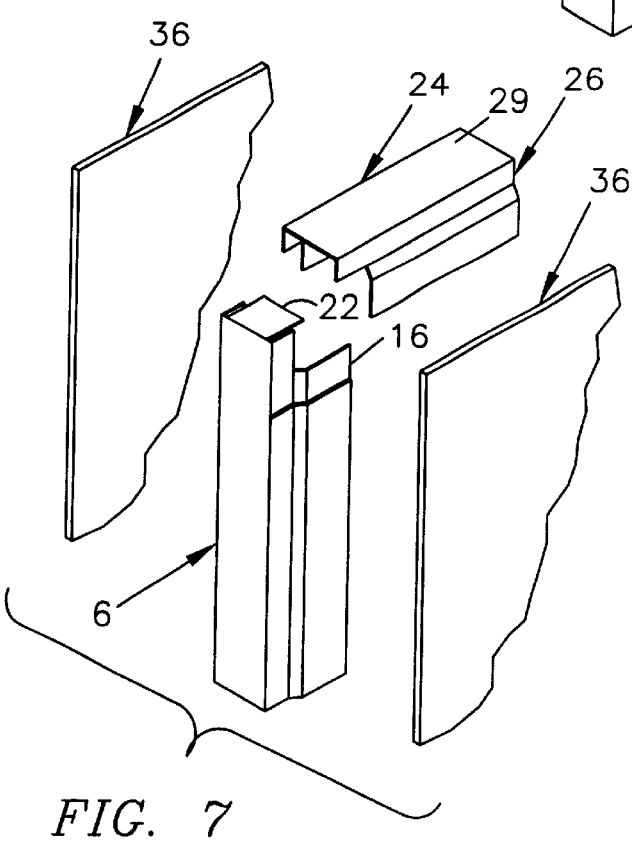
FIG. 7 is an exploded, perspective, view of one corner of the first embodiment of the six panel door of the present invention unassembled minus the foam core.
Figure 10:
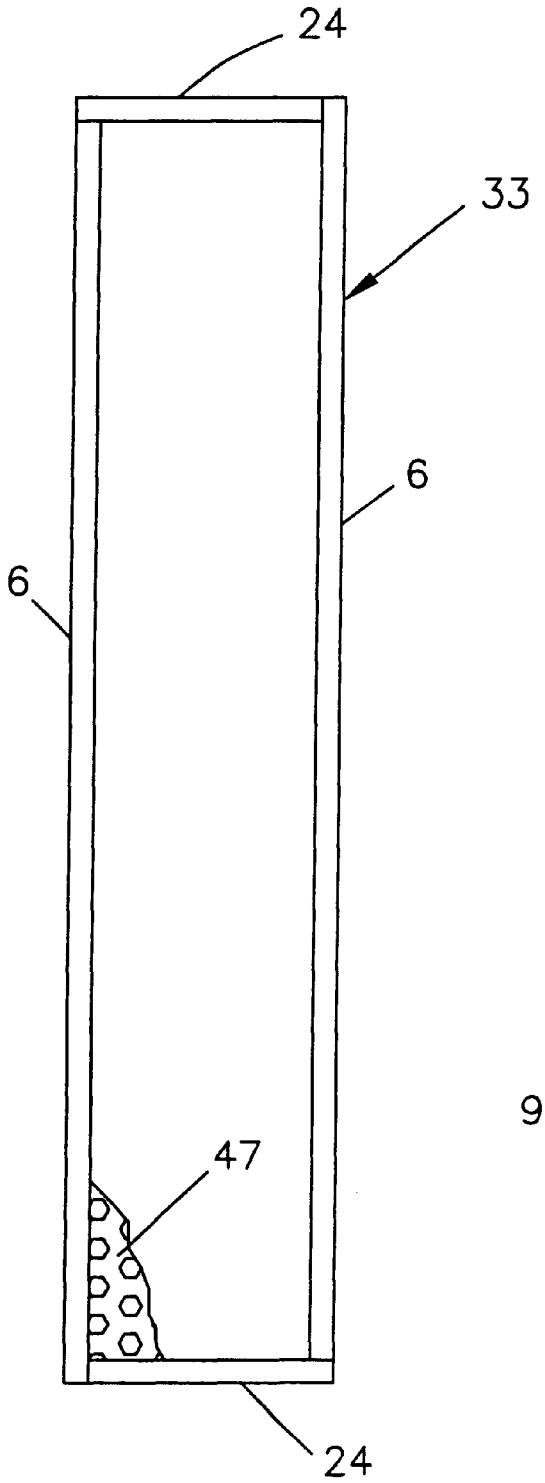
FIG. 10 is a side, partially broken away, elevational view of the foam core assembly incorporated in the first embodiment of the six panel door of the present invention.

As best seen in FIG. 3, the framed foam core assembly 4 comprises a pair of parallel, vertical, side stiles 6; and a pair of parallel, horizontal, rails or headers 24. A foam core 47 (FIGS. 4 and 10) is provided for completing each foam core assembly 4. As best seen in FIG. 6, each stile 6 is formed of metal stock (unnumbered), configured as a channel (unnumbered) having two legs 8 and a back portion 10 for connecting the legs 8. As best illustrated in FIG. 6, each leg 8 of each stile 6 has an inside surface 12 and an outside surface 14. The stiles 6 are cut to appropriate lengths and their legs 8 are formed inwardly an amount substantially equal to the thickness of the metal stock to form an inner section 18 and an outer section 20. One end of each stile 6 is further swaged inwardly to form a swaged end portion 16 (FIGS. 3 and 7). Each stile 6 further has an unswaged end portion 17 (FIG. 3). As best seen in FIGS. 3 and 7, a tab 22 is formed as an extension of the back portion 10 of each swaged end portion 16 of each stile 6 for purposes to be explained later. As best seen in FIGS. 3, 5, and 7, each rail or header 24 is formed of metal stock and is configured as a channel (unnumbered) having two legs 26 and a back portion 29 for connecting the legs 26. Each leg 26 has an inside surface 31 and an outside surface 32 with each back portion 29 having an inside surface 30. Each leg 26 is formed inwardly an amount substantially equal to the thickness of the metal stock to form an inner section 27 and an outer section 28. One end of each rail 24 is further swaged inwardly to form a swaged end portion 23 having a tab 21 forming an extension of back portion 29 as best seen in FIG. 3. Each rail or header 24 also has an unswaged end portion 25. The swaged end portion 23 of each rail 24 is identical to the swaged end portion 16 of each stile 6. To minimize the number of machine operations, a conventional cutting tool (not shown) is utilized for cutting each stile 6 and each rail 24 from previously rolled channel stock and the cutting tool is combined with a conventional swaging tool (not shown) for forming the inward swages (unnumbered) separating the inner sections 18 and 27 and the outer sections 20 and 28, and the swaged end portions 16 and 23. This allows the cutting and swaging of the channel metal stock to be accomplished in a single operation. As should be apparent, the major difference between a stile 6 and a rail 24 would be in their length, with the stiles 6 being longer. As viewed in FIG. 3, the swaged end portion 16 of the left stile 6 is at the top, the swaged end portion 16 of the right stile 6 is at its bottom, the swaged end portion 23 of the upper rail 24 is on the right, and the swaged end portion 23 of the lower rail 24 in on the left.

Figure 8:
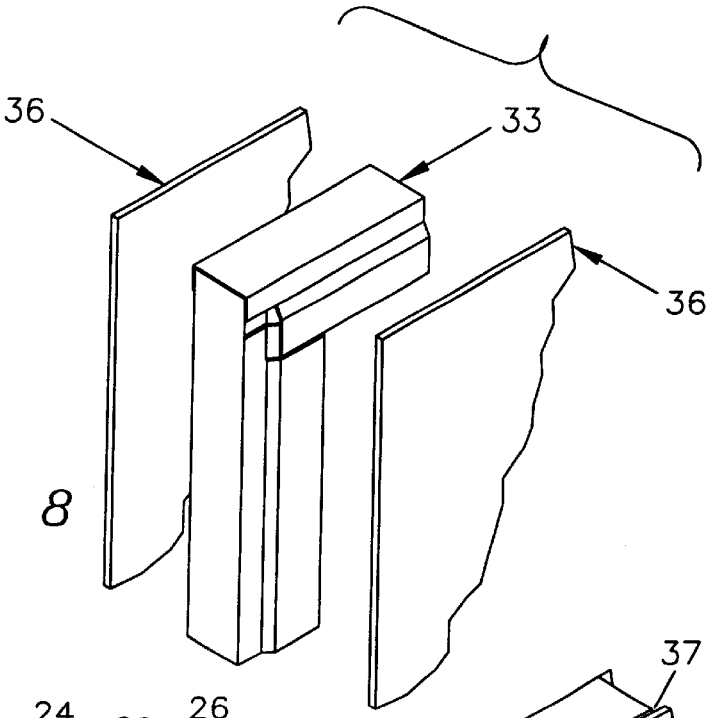
FIG. 8 is an exploded, perspective, view of one corner of the first embodiment of the six panel door of the present invention assembled in part.
Figure 9:
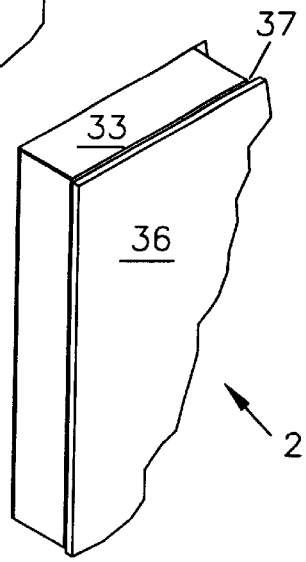
FIG. 9 is a perspective view of one corner of the first embodiment of the six panel door of the present invention.

In forming the rectangular frame 33 for the first embodiment as best illustrated in FIGS. 3, 7, and 8, the swaged end portion 16 of each stile 6 with its tab 22 bent at approximately ninety degrees (90°) from back portion 10 is inserted within a respective unswaged end 25 of an adjacent rail 24 such that the tab 22 engages the inside surface 30 of a respective rail 24, and the swaged end portion 23 of each rail 24 is inserted within an adjacent unswaged end 17 of an adjacent stile 6 such that the tab 21 of each rail 24 engages the inner surface 22 of an adjacent stile 6, so as to form four corners (unnumbered) of the frame 33. The top left-hand assembled corner of frame 33 is best shown in FIGS. 8 and 9. The other three assembled corners are substantially identical to the top left-hand corner except for the locations of the swaged end portions 16 and 23 and the unswaged end portions 17 and 25. The inside surfaces 12 of the swaged end portion 16 of each stile 6 are spaced apart a distance slightly less than the outside surface (unnumbered) of an unswaged end 25 of an adjacent rail 24 such that the swaged end portion 16 of each stile 6 can be frictionally received easily within the unswaged end of the adjacent rail 24. Further, the inside surfaces 31 of the swaged end portion 23 of each rail 24 are spaced apart a distance slightly less than the outside surface (unnumbered) of an unswaged end 17 of an adjacent stile 6 such that the swaged end portion 23 of each rail 24 can be frictionally received easily within the unswaged end 17 of the adjacent stile 6. In the assembly of the door frame 33, the swaged end portions 16 and 23 of the stiles 6 and the rails 24 respectively might be considered to be male members and the unswaged end portions 17 and 25 of the stiles 6 and the rails 24 respectively might be considered female members. As best seen in FIGS. 3 and 7, the outer section 20 of each leg 8 of stile 6 is somewhat longer than the inner section 18 of each stile 6 to provide a notch (unnumbered), and the outer section 28 of each leg 26 of each rail 24 is somewhat longer than the inner section 27 of rail 24 to provide a notch (unnumbered). As illustrated in FIG. 8, which shows the details of the upper left corner (unnumbered) of the rectangular frame 33, the swaging provides a unique arrangement wherein the outer faces (unnumbered) on each side of the door frame 33 align to form a substantially planar surface. This feature permits the addition of skins 36 to a completed door 2 as explained later. In addition, the corner configurations provide a friction fit between the stiles 6 and rails 24 which furnishes added integrity to the frame 33 during the assembly process.

That is to say, the friction fit of the corners aids in retaining the door frame 33 in accurate alignment as it is assembled in a jig, as will be described hereinafter. Yet another feature of this corner configuration is the fact that while the corners have no protrusions, the swaged end portions 16 and 23 of the stiles 6 and rails 24 provide a surface to surface contact with the inner surfaces 12 and 31 of the unswaged ends 16 and 25 of the adjacent rails 24 and stiles 6 making up the frame 33. The advantages of this feature will become more apparent hereinafter wherein a gluing process will be described in which the inner surfaces 12 and 31 of the stiles 6 and rails 24 are coated with a heat-activated adhesive or glue. It will be readily understood that the outer surfaces of the swaged end portions 16 and 23 of the stiles 6 and rails 24 will engage and be firmly in contact with the glue coated inner surfaces 12 and 31 of its adjoining stile 6 or rail 24, thus providing an extremely rigid corner connection upon activation of the heat activated glue. It is pointed out that prior to assembly of the stiles 6 and rails 24, the heat-activated glue is applied to the entire inner surfaces 12 and 31 of each of the stiles 6 and rails 24. Thus, during the molding operation the heat which is applied serves not only in the molding process itself, but also activates the glue which, upon activation, provides a firm bond between the metal tabs 22 and 21 and the adjacent surfaces of the stiles 6 and the rails 24 as well as between the inner surfaces of the stiles 6 and rails 22 and the molded foam 47.

Figure 11:
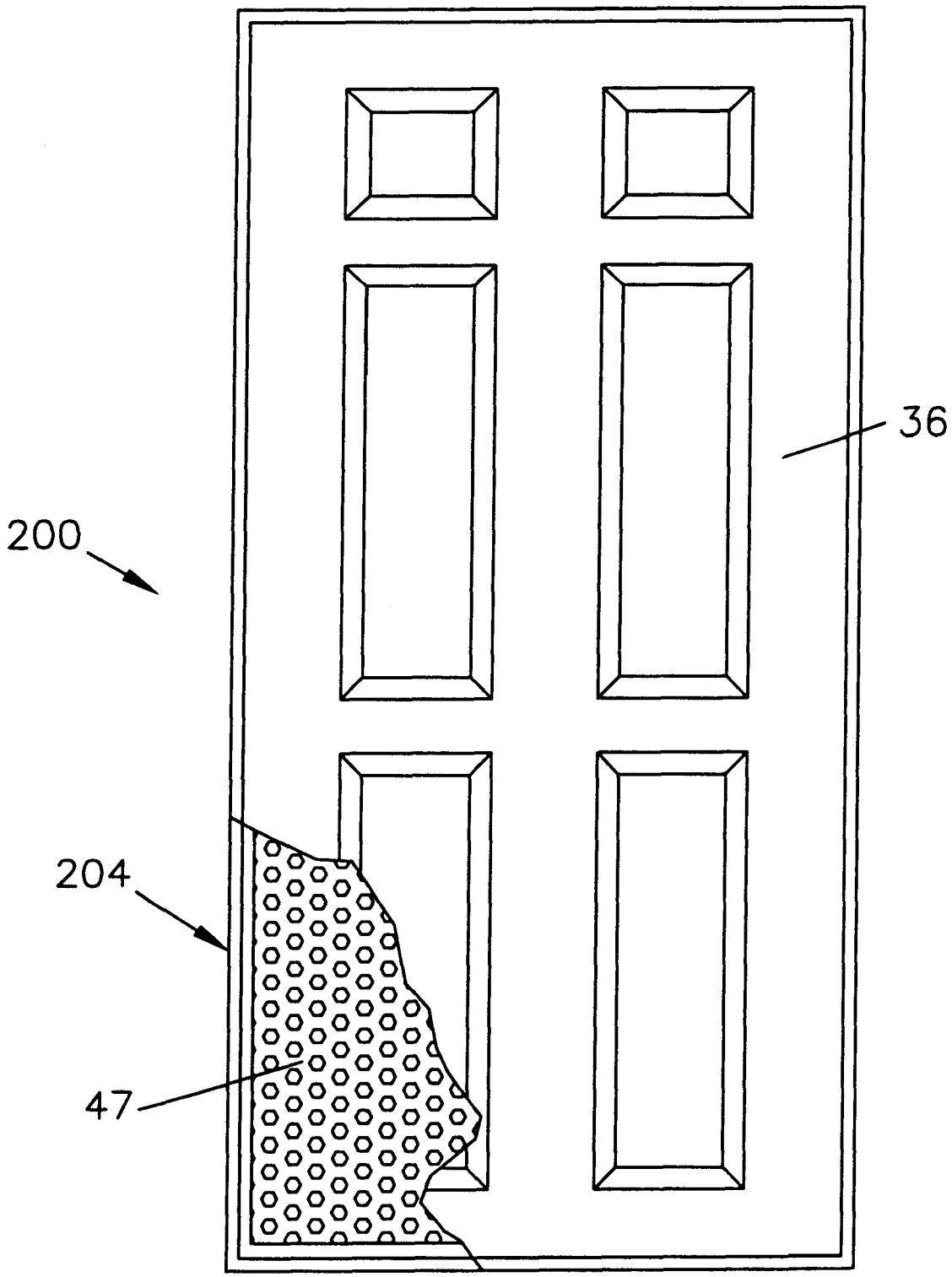
FIG. 11 is a front, partially broken away, elevational view of a second, preferred, embodiment of the six panel steel door of the present invention with the outer skin shown partially removed to illustrate the foam interior of the door.

Referring now to the drawings, particularly FIGS. 11–20 thereof, reference numeral 200 generally designates the second or preferred embodiment of the door of the present invention. As best seen in FIG. 11, door 200 generally comprises a steel-framed foam core assembly 204, and a pair of skins or coverings 36.

Figure 12:
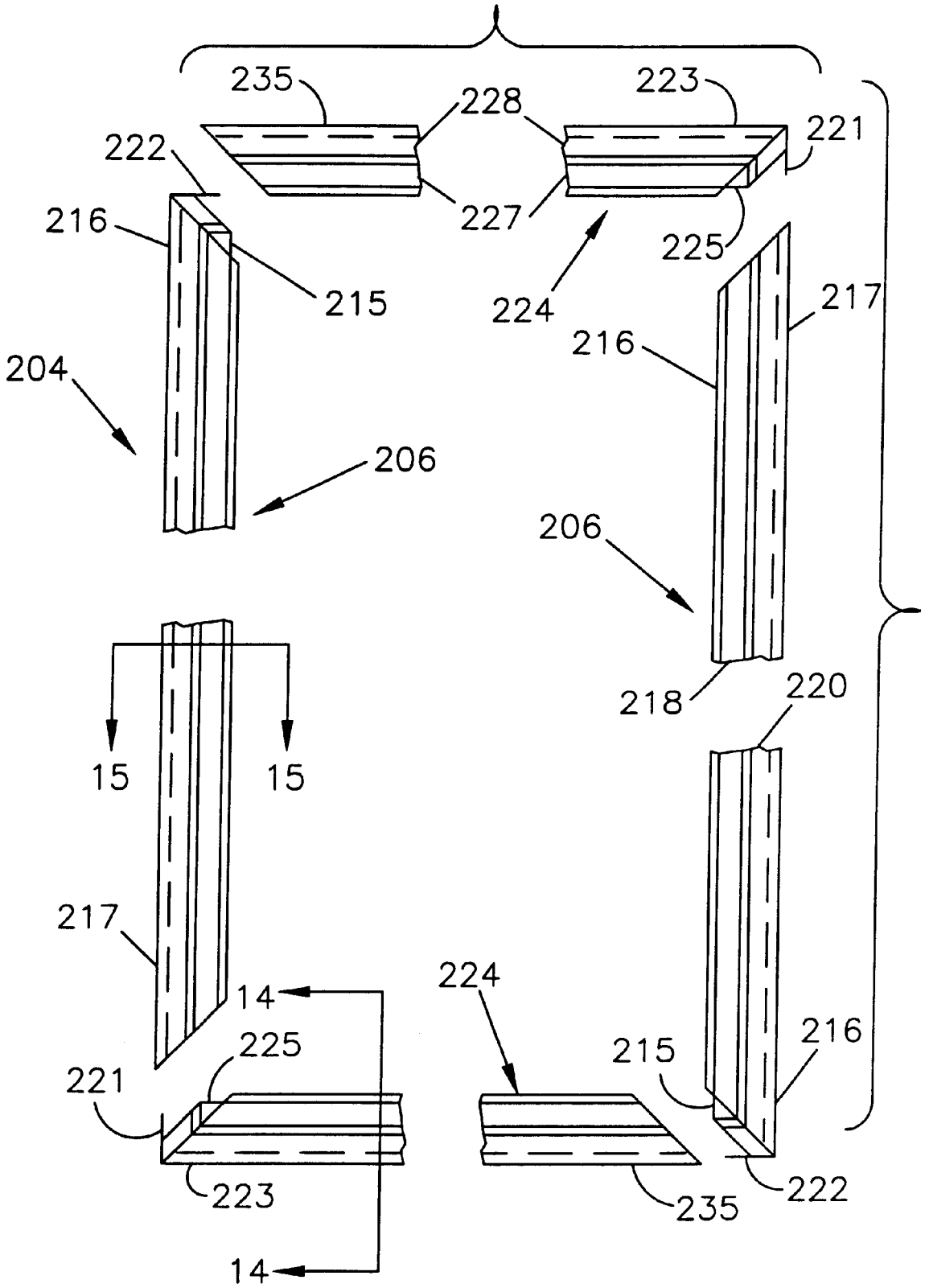
FIG. 12 is a front elevational, partially broken away, exploded, view of the two rails or headers and two stiles for incorporation into the second embodiment of the door of the present invention.
Figure 15:
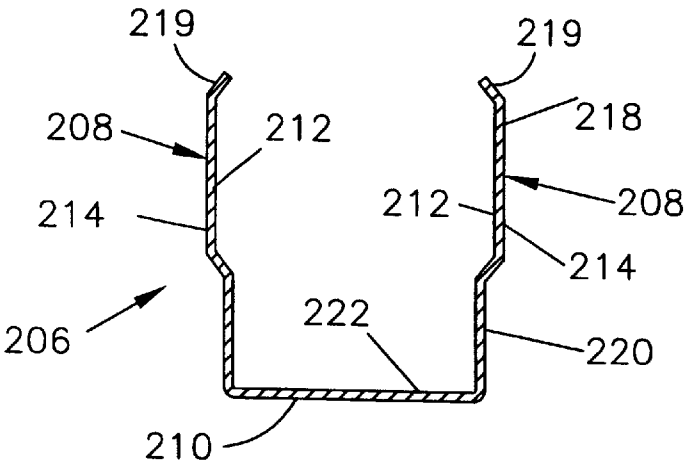
FIG. 15 is a cross-sectional view of one of the stiles, taken along line 15—15 of FIG. 12, for the steel frame of the foam core assembly incorporated in the second embodiment of the six panel door of the present invention
Figure 14:
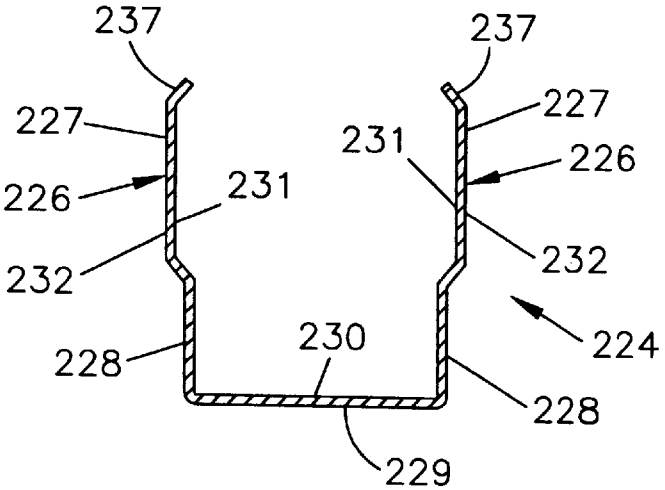
FIG. 14 is a cross-sectional view of one of the rails, taken along line 14—14 of FIG. 12, for the steel frame of the foam core assembly incorporated in the second embodiment of the six panel door of the present invention.
Figure 17:
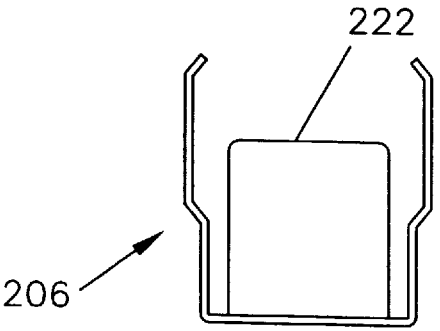
FIG. 17 is an end view of one of the stiles incorporated in the second embodiment of the six panel door of the present invention.

As best seen in FIG. 12, the framed foam core assembly 204 comprises a pair of parallel, vertical, side stiles 206; a pair of parallel, horizontal, rails or headers 224; and a foam core 47 (FIG. 11). As best seen in FIGS. 12 and 15, each stile 206 is formed of metal stock (unnumbered), configured as a channel (unnumbered), having two legs 208 and a back portion 210 for connecting the legs 208. As best illustrated in FIG. 15, each leg 208 of each stile 206 has an inside surface 212 and an outside surface 214. The stiles 206 are cut to appropriate lengths and their legs 208 are formed inwardly an amount substantially equal to the thickness of the metal stock to form an inner section 218 with a turned in appendage 219 and an outer section 220. One end of each stile 206 is further swaged inwardly to form a swaged end portion 216 (FIG. 12) which terminates in a flap 215 and a tab 222. Each stile 206 further has an unswaged end portion 217. As best seen in FIGS. 12 and 17, a tab 222 is formed as an extension of the back portion 210 of each swaged end portion 216 of each stile 206 for purposes to be explained later. As best seen in FIGS. 12 and 14, each rail or header 224 is formed of metal stock and is configured as a channel (unnumbered) having two legs 226 and a back portion 229 for connecting the legs 226. Each leg 226 has an inside surface 231 and an outside surface 232 with each back portion 229 having an inside surface 230. Each leg 226 is formed inwardly an amount slightly in excess of the thickness of the metal stock to form an inner section 227 with a turned in appendage 237 and an outer section 228. One end of each rail 224 is further swaged inwardly to form a swaged end portion 223 having a flap 225 and a tab 221 which forms an extension of back portion 229 as best seen in FIG. 11. Each swaged end portion 223 terminates in a flap 225. Each rail or header 224 also has an unswaged end portion 235. The swaged end portion 223 of each rail 224 is identical to the swaged end portion 216 of each stile 206. To minimize the number of machine operations, a conventional cutting tool (not shown) is utilized for cutting each stile 206 and each rail 224 from channel stock and the cutting tool is combined with a conventional swaging tool (not shown) for forming the offset (unnumbered) separating the inner sections 218 and 227 and the outer sections 220 and 228, and the swaged end portions 216 and 223. This allows the cutting and swaging of the channel metal stock to be accomplished in a single operation. As should be apparent, the major difference between a stile 206 and a rail 224 would be in their length, with the stiles 206 being longer. As viewed in FIGS. 11, the swaged end portion 216 of the left stile 206 is at the top, the swaged end portion 216 of the right stile 206 is at its bottom, the swaged end portion 223 of the upper rail 224 is on the right, and the swaged end portion 223 of the lower rail 224 in on the left.

Figure 18:
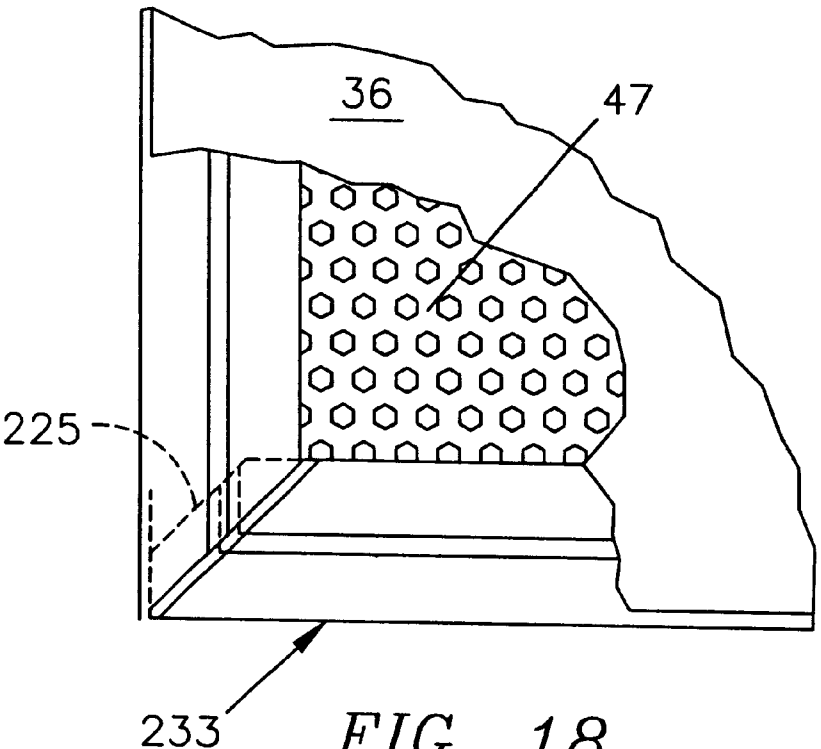
FIG. 18 is a front elevational, partially broken away, view of the bottom, left-hand, corner of the second embodiment of the six panel door of the present invention.
Figure 16:
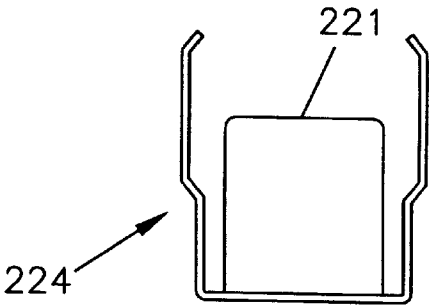
FIG. 16 is an end view of one of the rails incorporated in the second embodiment of the six panel door of the present invention.

In forming the rectangular frame 233 of the second or preferred embodiment as best illustrated in FIGS. 12 and 18, the swaged end portion 216 of each stile 206 with its tab 222 bent at approximately ninety degrees (90°) from back portion 210 together with flap 215 is inserted within a respective unswaged end 235 of an adjacent rail 224 such that the tab 222 engages the inside surface 230 of the adjacent rail 224, and the swaged end portion 223 together with flap 225 of each rail 224 is inserted within an adjacent unswaged end 217 of an adjacent stile 206 such that the tab 221 of each rail 224 engages the inner surface 222 of an adjacent stile 206, so as to form four corners (unnumbered) of the frame 233.

The bottom left-hand assembled corner of frame 233 is best shown in FIG. 18. The other three assembled corners are substantially identical to the bottom left-hand corner except for the locations of the swaged end portions 216 and 223 and the unswaged end portions 217 and 235. The inside surfaces 212 of the swaged end portion 216 of each stile 206 are spaced apart a distance slightly less than the outside surface (unnumbered) of an unswaged end 235 of an adjacent rail 224 such that the swaged end portion 216 and flap 215 of each stile 206 can be frictionally received easily within the unswaged end 235 of the adjacent rail 224. Further, the inside surfaces 231 of the swaged end portion 223 and flap 225 of each rail 224 are spaced apart a distance slightly more than the outside surface (unnumbered) of an unswaged end 217 of a adjacent stile 206 such that the swaged end portion 223 and flap 225 of each rail 224 can be frictionally received easily within the unswaged end 217 of the adjacent stile 206. As best seen in FIG. 12, the unswaged end portion 217 and the swaged end portion 216 of each stile 206 is cut at a forty-five degree (45°) angle and the unswaged end portion 223 and the swaged end portion 235 of each rail 224 are cut at a forty-five degree (45°) angle. As best illustrated in FIG. 18, which shows the details of the lower left corner (unnumbered) of the rectangular frame 233, the swaging provides a unique arrangement wherein the outer faces (unnumbered) on each side of the door frame 233 align to form a substantially planar surface. This feature permits the addition of skins 36 to completed door 200 as explained later. In addition, the corner configurations provide a friction fit between the stiles 206 and rails 224 which furnishes added integrity to the frame 233 during the assembly process. In the assembly of the door frame 233, the swaged end portions 216 and 223 of the stiles 206 and the rails 224 respectively might be considered to be male members and the unswaged end portions 217 and 235 of the stiles 206 and the rails 224 respectively might be considered to be female members.

That is to say, the friction fit of the corners aids in retaining the door frame 233 in accurate alignment as it is assembled in a jig, as will be described hereinafter. Yet another feature of this corner configuration is the fact that while the corners have no protrusions, the swaged end portions 216 and 223 of the stiles 206 and rails 224 provide a surface to surface contact with the inner surfaces of the unswaged ends 217 and 235 of the adjacent rails 224 and stiles 206 making up the frame 233. The advantages of this feature will become more apparent hereinafter wherein a gluing process will be described in which the inner surfaces of the stiles 206 and rails 224 are coated with a heat-activated adhesive or glue. It will be readily understood that the surfaces of the swaged end portions 216 and 223 of the stiles 206 and rails 224 will be firmly in contact with the glue coated inner surfaces of its adjoining stile 206 or rail 224, thus providing an extremely rigid corner connection upon activation of the heat activated glue. It is pointed out that prior to assembly of the stiles 206 and rails 224, the heat-activated glue is applied to the entire inner surfaces 212 and 231 of each of the stiles 206 and rails 224. Thus, during the molding operation the heat which is applied serves not only in the molding process itself, but also activates the glue or adhesive which, upon activation, provides a firm bond between the metal tabs 222 and 221 and the inner surfaces 212 of the stiles 206 and the inner surfaces of rails 224 as well as between the inner surface of the stiles 206 and rails 224 and the molded foam 47.

Figure 19:
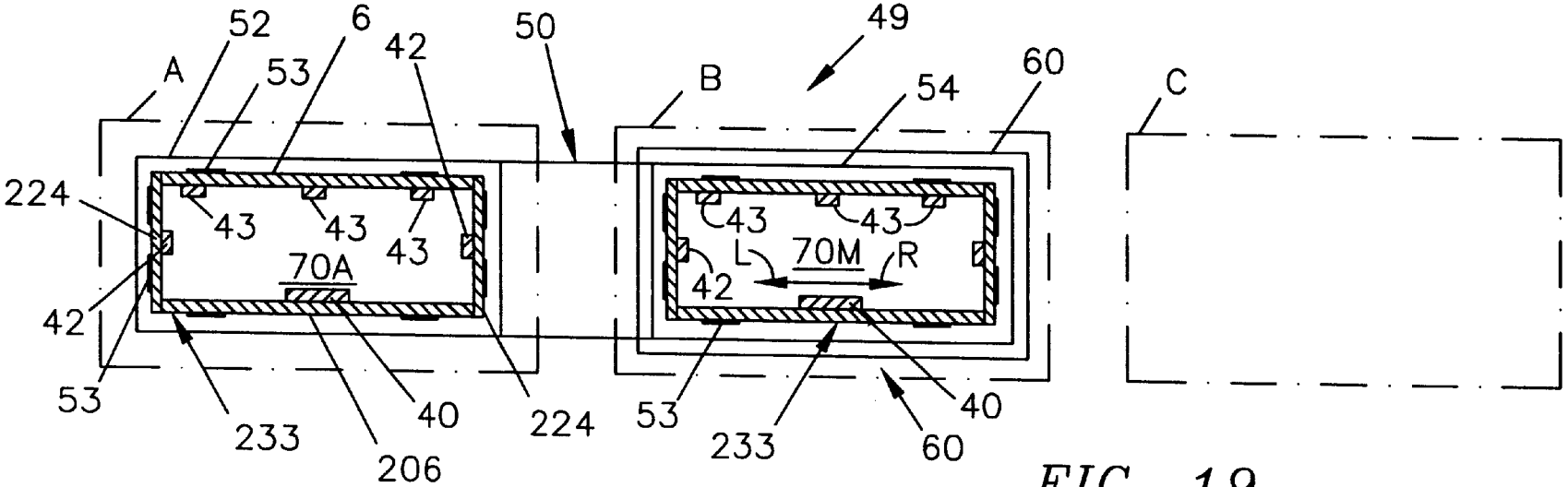
FIG. 19 is a diagrammatic illustration of a movable two-section shuttle in a "left" position within hypothetical work stations shown by phantom lines, and a molding press which contain the right-most shuttle section, shown for forming the second embodiment foam core assembly.
Figure 20:
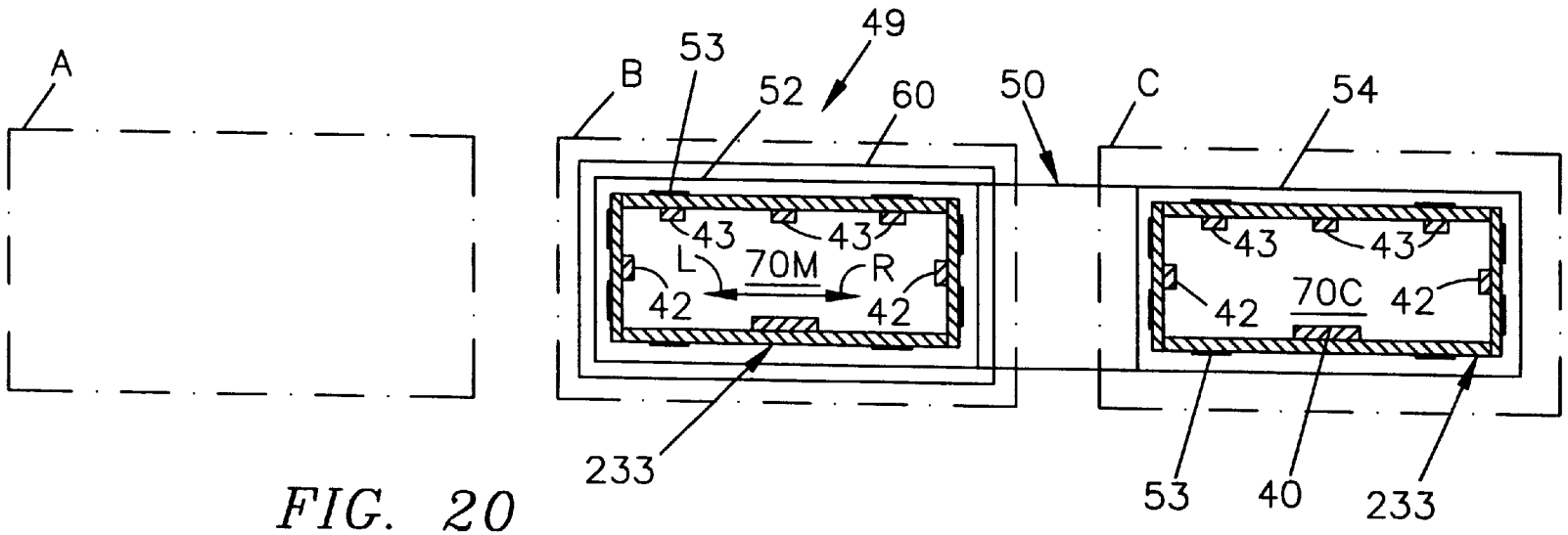
FIG. 20 is a diagrammatic illustration as in FIG. 19, but wherein the movable two-section shuttle is shown in the "right" position.
Figure 21:
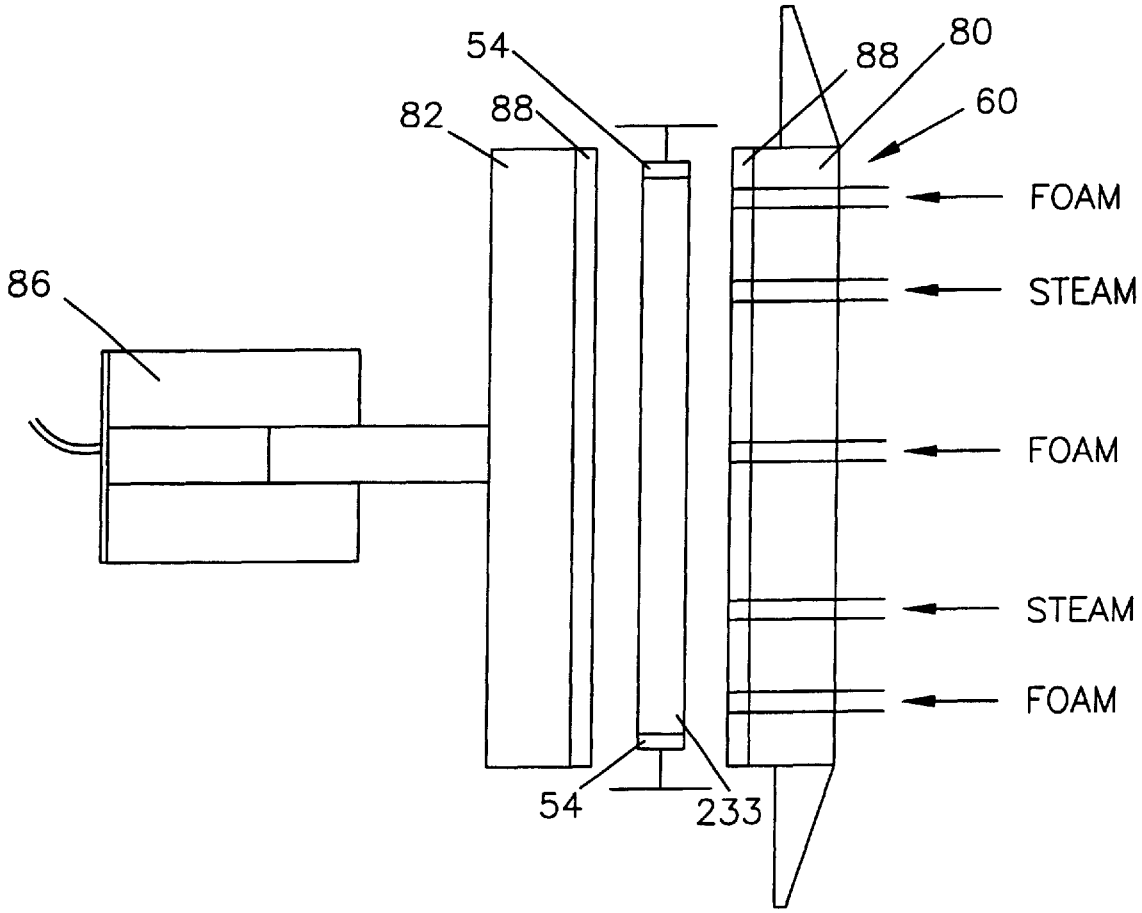
FIG. 21 is a diagrammatic illustration of the molding press as shown in FIGS. 19 and 20.

As best seen in FIGS. 19 and 20, and using the second embodiment of the frame 233 for illustrative purposes, reinforcement inserts such as 40, 42, and 43, may be inserted into the channel of a stiles 206 and/or rails 224 to provide additional strength for any selected portion of the foam core assembly 204 and thus provides a firm foundation for attachment of ancillary to equipment to a completed panel. These inserts 40,42, and 43 are typically preformed from a high strength foam of other suitable material, and are configured to provide a friction fit within the stiles 206 and rails 224 so as to be held firmly in place by the legs 208 and 226 of the stiles 206 and rails 224 (FIGS. 11 and 12) during the molding process. The specific locations of the reinforcement inserts 40, 42, and 43 as illustrated are applicable to the use of the unitary framed foam core assembly 204 as the foundation of a door 200. In this example, the insert 40 provides a reinforced area to which a latching and locking mechanism will be installed. Similarly, reinforcement inserts 42 and 43 may be provided for attachment of door closing mechanisms and hinges, respectively. As will be readily understood, such reinforcements may be utilized in a variety of sizes, shapes, and locations in application of the framed door core assembly 204 to uses other than the illustrated door 200. As best seen in FIG. 19 and as will be described in detail hereinafter, the frame 233 is assembled in a jig and the reinforcement inserts 40, 42, and 43 are attached prior to a molding process during which the frame 233 is filled with a foam material 47 (FIG. 21). It is apparent that the inserts 40, 42, and 43 can also be incorporated in the first embodiment of the framed foam core assembly 4.

As illustrated schematically in FIGS. 19 and 20, and using the second embodiment for illustrative purposes, except for the preparatory operation in the forming and glue coating of the stiles 206 and the rails 224, the method of fabricating the unitary foam core assemblies 204 are accomplished within a three station fabrication device 49. Within the fabrication device 49, stations delineated individually by phantom lines and designated as "A" and "C" are personnel work stations and a station designated as station "B" includes an automated foam molding press 60 positioned generally intermediate work stations "A" and "C". As illustrated diagrammatically in FIG. 21, the foam molding press 60 generally includes a stationary mold 80 having inlets (unnumbered) therein for the introduction of foam and steam, a movable mold 82, platens 88 having the configuration of the six panel door built therein, and a hydraulic actuator 86 connected to the movable mold 82. As illustrated diagrammatically in FIG. 21, foam and steam is fed into the molding press 60 through the inlets in stationary mold 80 wherein it is molded into the metal frame 233 by the application of heat and pressure. During operation of the molding press, the platen 88 secured to the movable mold 82 is brought toward the platen 88 secured to the stationary mold 80 by hydraulic actuator 86 so as to contact each side of the frame 233. Foam 47 is then fed in to firmly fill the frame 233. Steam is applied at a pressure of between 12 and 18 PSI, while temperatures of between 220 and 240 degrees Fahrenheit are attained. Water and vacuum are utilized for partial cooling and stabilization of the foam core assembly 204 prior to removal from the molding press 60. As illustrated in FIGS. 19 and 20, the fabrication device 49 also includes a shuttle 50 having two sections 52 and 54. The shuttle 50 automatically moves to the "right" and "left" through the molding press 60 so as to present one section to a work station for frame assembly while the other section is positioned in the molding press for molding the panels into a final configuration 70C (FIG. 20). The assembly of each metal frame 233 is accomplished within the jig sections 52 and 54 in the manner previously described. A plurality of magnetic retainers 53 are attached within the jig sections 52 and 54 to temporarily secure the individual stiles 206 and rails 224 of the frame 233 during assembly within the jig sections. This arrangement facilitates the rapid assembly of the metal frame 233 in that the individual members (two stiles 206 and two rails 224) of the frame 233 are firmly retained in the jig upon contact with the magnets 53, while yet permitting sliding adjustments along the surface of the magnets 53 during final positioning of the frame members (two stiles 206 and two rails 224) within the jig. The schematic illustrations of the molding press 60 show the molding press 60 as being open to the viewer so as to illustrate the positions of the shuttle 50 as it assumes the positions it occupies during the molding operations. As indicated by the arrowheads "L" and "R" illustrated within the automated foam molding device, the shuttle 50 moves back and forth (left and right) within the molding device from the left position illustrated in FIG. 19 to the right position as illustrated in FIG. 20. Assuming the jig section 54 already includes an assembled frame 233 the sequence of operation begins with the shuttle in the "left" position. In the "left" position a frame 233 is assembled within jig section 52. Upon completion of the molding operation the shuttle automatically moves to the "right" position (FIG. 20). In the right position, section 52 of the shuttle contains a panel 70M during the molding process wherein a frame 233 is being filled with foam 47 which is molded by a heating and pressure process. It will be noted that the letters "A," "M," and "C", when following a numeral in the drawings, designates a panel in an Assembly stage, a Molding stage or a Completed stage respectively. In this ("right") position while the panel 70M within the molding press 60 is being filled with foam and molded, the panel 70C within section 54 has been completed and is ready for removal from the shuttle. Upon removal of the finished panel, an additional four-piece metal frame 233 will be assembled within section 54 of the shuttle in preparation for movement to the next position (back to the "left"). Upon completion of the foam core assembly 204 in section 54, the shuttle 50 is ready for movement back to the "left" position of the shuttle. Again the timing of movements of the shuttle 50 is predetermined and begins upon completion of the molding operation within the automated molding press 60. Upon completion of the molding process the shuttle 50 will return to the "left" position as illustrated in FIGS. 19 and 20 for removal of a completed panel in preparation for assembly of another frame 233 in the jig section 52. This completes one cycle of the fabrication mechanism. It is further apparent that the first embodiment of the framed core assembly 4 can also be fabricated in a similar manner.

Figure 13:
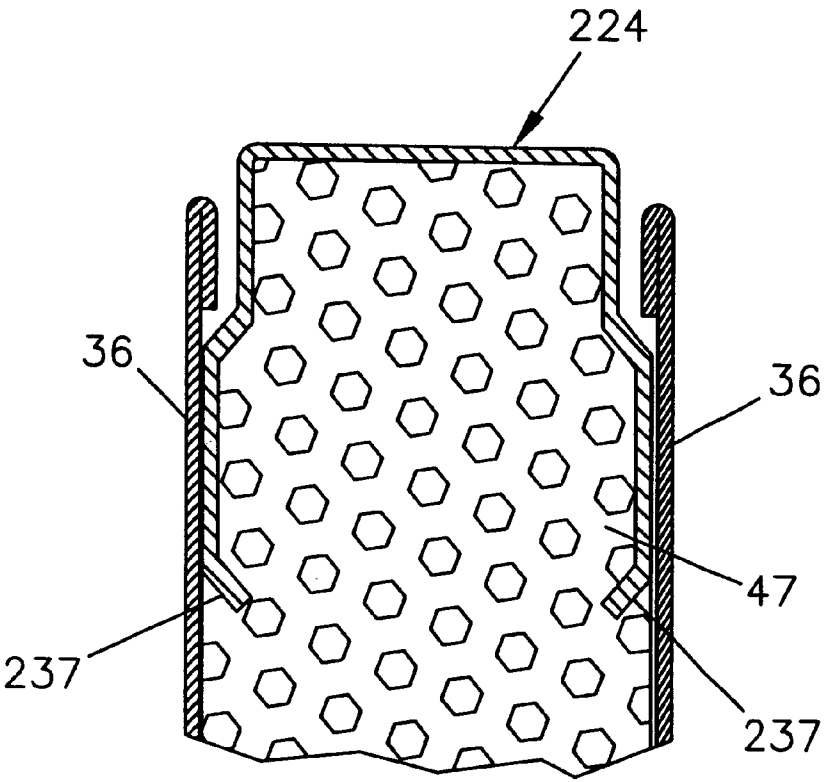
FIG. 13 is a partially broken away, cross-sectional, view showing some of the details of one -rail, the foam core, and the two skins of the second embodiment of the six panel door of the present invention.

During the molding process for the second or preferred embodiment of the invention, foam 47 which is forced into the frame 233 goes to both sides of the turned in appendages 219 and 237 of each stile 206 and each rail 224, respectively, to provide further rigidity to the framed foam core assembly 204. This feature is shown in FIG. 13.

Figure 22:
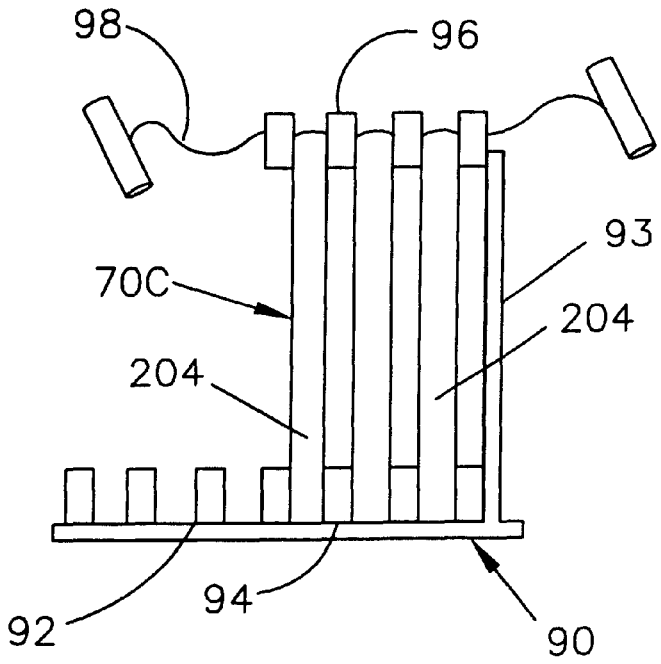
FIG. 22 is an elevational end view of a cooling stand having a number of completed second embodiment foam core assemblies therein.

It is noted that upon removal of finished foam core assembly 204 such as 70C from the molding press 60, the temperature of the foam core assembly 204 is quite high. As the foam cools, it contracts. Accordingly, special care is required in the stacking of finished foam core assemblies 204 in that the foam core assemblies 204 must be arranged and supported in a parallel and equidistant spaced-apart relationship to provide uniform cooling which is imperative to prevent warping which will occur if the cooling of the panels is not closely controlled. As illustrated in FIG. 22, a cooling rack 90 is provided for reception of the panels (framed core assemblies 204) as they are removed from the shuttle 50. The cooling rack 90 includes a base 92 having upwardly extending spacer bars 94 for retaining and evenly spacing the completed foam core assemblies 204 during the controlled cooling thereof. A plurality of spacers 96 are attached to a line 98 so as to maintain a uniform spacing between the panels. The rack 90 as well as the spacers 96 are configured to maintain a spacing of one eighth to one quarter of an inch between the cooling panels. This spacing provides the controlled cooling of the hot panels which is necessary to prevent the panels from the warpage which would otherwise occur.

Figures 23, 24, 25, 26, 27:
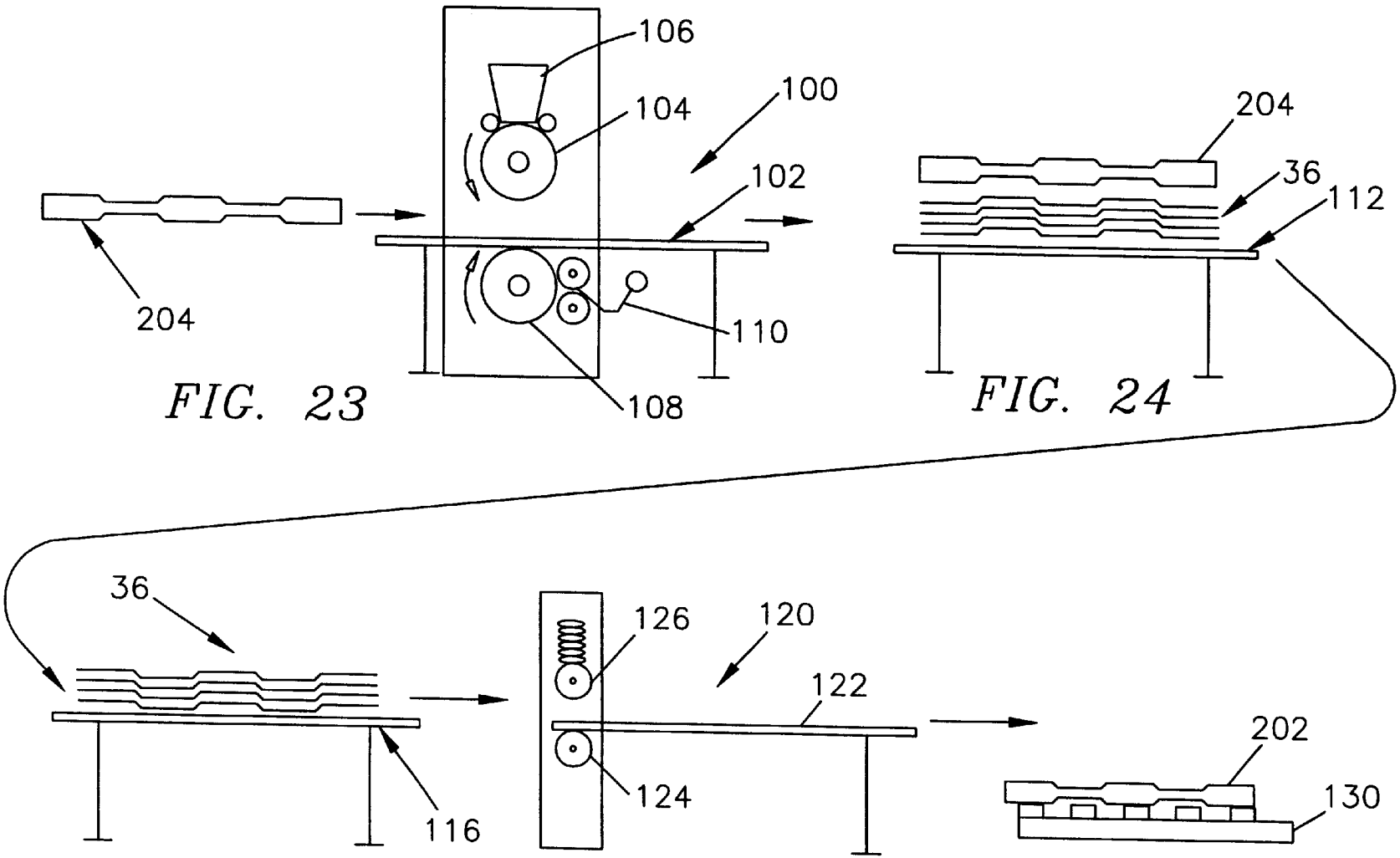
FIG. 23 is a side elevational view of the second embodiment steel-framed foam core assembly just prior to entry into a roll coating machine which applies adhesive to the inner and outer faces of the second embodiment steel-framed foam core assembly.
FIG. 24 is a side elevational view of a table having a number of skins stacked thereon and about to have one face of a second embodiment steel-framed foam core assembly lowered onto the inner face of the uppermost skin to secure the uppermost skin to the second embodiment steel-framed foam core assembly.
FIG. 25 is a side elevational view of a table having a number of steel skins stacked thereon for removal and placing on the other face of a second embodiment steel-framed foam core assembly resting on the table shown in FIG. 26 to secure the uppermost skin to the second embodiment steel-framed foam core assembly.
FIG. 26 is a side elevational view of a nip roller machine adapted for the passing therethrough of a completed door to apply pressure to both steel skins to firmly secure the steel skins to the steel-framed foam core assembly.
FIG. 27 is a side elevational view of a pallet having one completed door stacked thereon.

FIGS. 23 through 26 provide a diagrammatic flow illustration showing one method of applying the skins 36 to the outer faces of assembled framed core assemblies 204. Reference numeral 204 (FIGS. 23 and 24) designates a molded framed core assembly just prior to having a skin 36 (bottom skin) applied and secured to one face of the framed core assembly 204 and as seen in FIG. 23, reference numeral 100 designates a conventional roll coating machine comprising a horizontal table 102, an upper silicone roller 104, an upper adhesive supply tank 106, a lower silicone roller 108, and a lower adhesive supply tank 110. The roll coating machine 100 is further provided with conventional heating mechanisms (not shown) for heating the adhesive to the order of 280° to 300° Fahrenheit. As seen in FIG. 24, reference numeral 112 designates a table for supporting a stack of steel skins 36 (bottom skins) having their outer faces facing downwardly and their inner faces facing upwardly. As seen in FIG. 25, reference numeral 116 designates a table having a stack of steel skins 36 (top skins) having their outer faces facing upwardly and their inner faces facing downwardly. As seen in FIG. 26, reference numeral 120 designates a conventional nip rolling machine comprising a table 122, and a pair of power driven, spring-urged, rollers 124.

In performance of the method of fabrication of the six panel door 202 of the second or preferred embodiment of the invention, the following is the sequence of the basic steps involved therein.

(a) Provide two channel shaped stiles 206 and rails 224 of predetermined lengths, each stile 206 having a swaged end portion 216, an unswaged end portion 217, and having inner and outer surfaces and each rail 224 having a swaged end portion 223, an unswaged end portion 235, and inner and outer surfaces.

(b) Coat inner surfaces of each stile 206 and each rail 224 with heat activated glue or adhesive.

(c) Assemble the stiles 206 and rails 224 into a rectangular frame 233 by fitting a swaged end portion 216 with its tab 222 and flap 215 of each stile 206 into an unswaged end portion 235 of an adjacent rail 224 and a swaged end portion 223 with its tab 221 and flap 225 of each rail 224 into an unswaged end portion 217 of an adjacent stile 206.

(d) Frictionally position the reinforcement inserts 40, 42, and 43 into selected locations within the channels of the stiles 206 and the rails 224 (FIG. 19).

(e) Place the assembled frame 233 in a foam molding press 60.

(f) Fill the assembled frame 233 with foam material 47.

(g) Mold the foam 47 within the frame 233 by the introduction of pressurized, high temperature, steam into the foam molding press 60.

(h) Remove the molded framed foam assembly 204 from the molding press 60.

(i) Control the cooling of the molded frame foam assembly 204 so as to prevent warping of the frame foam assembly 204.

(j) Place an assembled and cooled molded frame assembly 204 upon the horizontal table 102 of the conventional roll coating machine 100 (FIG. 23) and move the molded frame assembly 204 through the roll coating machine 100 such that the rollers 104 and 108 coat the inner section 218 of each leg 208 of each stile 206, the inner section 227 of each leg 226 of each rail 224 and the inner and outer faces of the foam 47 with hot glue or adhesive.

(k) Removing the molded frame assembly 204 with its inner and outer faces and the inner sections 218 of each stile 206 and the inner section 227 of each rail 224 together with the foam 47 coated with hot adhesive and gently placing the molded frame assembly 204 upon the uppermost bottom skin 36 stacked on table 112 (FIG. 24) and properly aligning the bottom skin 36 such that a one-eighth inch (⅛") border 37 (FIGS. 1 and 11) is provided around the periphery of the framed core assembly 204.

(l) Lifting the uppermost skin 36 from table 116 and gently placing the skin 36 upon the adhesive coated foam core assembly 204 resting on table 112 (FIG. 24) to properly align the top skin 36 such that a one-eighth inch (⅛") border 37 (FIGS. 1 and 11) is provided around the periphery of the framed core assembly 204.

(m) Lightly pressing upon the uppermost skin 36 to assist adhesive contact between the framed core assembly 204 and the top and bottom skins 36.

(n) Passing the assembled door 202 between the rollers 124 of the nip rolling machine 120 to further assist adhesive contact between the framed core assembly 204 and the top and bottom skins 36 and to remove any air bubbles from beneath the inner surfaces of the skins 36. (The pressure is set such that the leading and trailing edges of the skins 36 do not deform when passing through the nip rolling machine 120 and any excess adhesive or glue is forced from beneath the skins 36 into the gap (not numbered) between the hem 38 of each skin 36 and the outer sections 220 and 228 of the stiles 206 and the rails 224.)

(o) The assembled door 202 is now ready for stacking horizontally on custom-made wood pallets 130 (FIG. 27) with foam sheets (not shown) placed between the pallet 130 and doors 202 to protect the doors 202.

The following is a detailed description of the sequence of steps involved in the fabrication of the second embodiment of the unitary framed foam assemblies 204 wherein the steps are interrelated to the cooperation between the steps of fabrication and the fabrication device 49 as illustrated in FIGS. 19 and 20. To simplify the explanation of a full cycle of operation it is assumed that the shuttle 50 is in the "left" position and that the cycle begins with a completed frame 33 having been assembled in jig section 52 which is positioned in the molding process.

(a) Provide two channel-shaped stiles 206 and rails 224 of predetermined lengths, each stile 206 having a swaged end portion 216 with a tab 222 and a flap 215, an unswaged end portion 217, and having an inner surface 212 and outer surface 214, each rail 224 having a swaged end portion 223 with a tab 221 and a flap 225, an unswaged end portion 235, an inner surface 231 and an outer surface 232.

(b) Coat the inner surface 212 of each stile 206 and the inner surface 231 of each rail 224 with a heat-activated glue or adhesive.

(c) In workstation "A"—(with shuttle 50 in a "left" position), assemble two stiles 206 and two rails 224 into a rectangular frame 233 within jig section 52 of shuttle 60 by inserting a swaged end portion 216 with flap 215 and tab 222 of each stile 206 into an unswaged end portion 235 of an adjacent rail 224, and inserting a swaged end position 223 with flap 225 and tab 221 of each rail 224 into an unswaged end portion 217 of an adjacent stile 206.

(d) Frictionally positioning the reinforcement inserts 40, 42, and 43 into selected locations within the channels of the stiles 206 and rails 224 (FIG. 19).

(e) Move shuttle 50 to its "right" position to transfer jig section 52 from station "A" to station "B", as jig section 54 moves from station "B" to station "C" (FIG. 20). This movement of shuttle 50 places the assembled frame 233 in a position for the molding operation.

(f) Perform molding operation in molding press 60 (station "B")—while molding operation is in progress in station "B", the following operations are performed in workstation "C"; (1) remove completed unitary framed foam assembly 70C from jig section 54, (2) place completed panel 70C in cooling rack 90 (FIG. 22), (3) assemble two stiles 206 and two rails 224 into a rectangular frame 233 within jig section 54 of shuttle 50 by inserting the swaged end portions 216 with flap 215 and tab 222 of each stile 206 into an unswaged end portion 235 of an adjacent rail 224, and inserting a swaged end portion 223 with flap 225 and tab 221 of each rail 224 into an unswaged end portion 217 of an adjacent stile 206. And frictionally position reinforcement inserts 40, 42, and 43 into selected positions within the channels of the stiles 206 and rails 224. (FIG. 19).

(g) Move shuttle 50 to its "left" position to transfer jig section 54 from station "C" back into molding press 60 (station "B") as jig section 52 moves back into work section "A".

(h) Perform molding operation in molding press 60 (station "B")—while molding operation is in progress in station "B", the following operations are performed in workstation "A"; (1) remove completed unitary framed foam assembly 70C from jig section 52, (2) place completed panel 70C in cooling rack 90 (FIG. 22) to complete the cycle.

(i) Passing an assembled and cooled molded frame assembly 204 through the conventional roll coating machine 100 (FIG. 23) and move the molded frame assembly 204 through the roll coating machine 100 such that the rollers 104 and 108 coat the inner section 218 of the legs 208 of each stile 206 and the inner section 227 of each leg 226 of each rail 224 and the inner and outer faces of the foam 47 with hot glue or adhesive.

(j) Removing the molded frame assembly 204 with its inner and outer faces and its inner sections 218 of each stile 206 and inner section 227 of each rail 224 coated with hot adhesive or glue and gently placing the molded frame assembly 204 upon the uppermost bottom skin 36 stacked on table 112 (FIG. 24) to properly align the bottom skin 36 such that a one-eighth inch (⅛") border 37 (FIGS. 1 and 11) is provided around the periphery of the framed core assembly 204.

(k) Lifting the uppermost skin 36 on table 116 (FIG. 24) from table 116 and gently placing it upon the adhesive coated foam core assembly 204 resting on table 112 to properly align the top skin 36 with the frame core assembly 4 such that a one-eighth inch (⅛") border 37 (FIGS. 1 and 11) is provided around the periphery of the framed core assembly 204.

(l) Lightly pressing upon the uppermost skin 36 to assist adhesive contact between the framed core assembly 204 and the top and bottom skins 36.

(m) Passing the assembled door 202 between the rollers 124 of the conventional nip rolling machine 120 to further assist adhesive contact between the framed core assembly 204 and the top and bottom skins 36 and to remove any air bubbles from beneath the inner surfaces of the skins 36. (The pressure is set such that the leading and trailing edges of the skins 36 do not deform when passing through the nip rolling machine 120 and any excess adhesive or glue is forced from beneath the skins 36 into the gap (not numbered) between the hem 38 of each skin 36 and the outer sections 220 and 228 of the stiles 206 and the rails 224.)

(n) The assembled door 202 is now ready for stacking horizontally on custom-made wood pallets 130 (FIG. 27) with foam sheets (not shown) placed between the pallet and doors 202 to protect the doors 202.

It will be readily appreciated that the above-described apparatus and the method of fabrication of the steel doors 202 are exceedingly cost effective. In this regard, it is noted that during the time taken by the molding process (typically 100 seconds), the personnel in the work stations remain productively occupied by removing and stacking the finished and cooled foam core assemblies 204, by assembly of the frame 33 and 233 in preparation for assembly and by retrieval and orderly arrangement of all assembly parts in preparation for the frame assembly process.

While the foregoing description of a preferred embodiment of the invention has been set forth with particular reference to a two person, manual, operation in several respects, it is apparent that the invention is equally applicable to mechanized operations. For example, the frame foam core assembly could be placed upon the steel skins by machinery rather than by individual. This might be done by movement of the frame core assemblies by suction cups which engage recessed areas of the frame core assembly. Still further, it is apparent that jigs could be used to assure the proper alignment of the frame core assemblies and the steel skins to provide the one-eighth inch (⅛") border around the periphery of the frame core assemblies.

Thus, although there have been described a particular embodiment of the present invention of a new and useful STEEL DOOR AND METHOD OF MAKING SAME, it is not intended that such references be construed as limitations upon the scope of this invention except as set forth in the following claims.

What is claimed is:

1. A rectangular door having inner and outer faces, said door comprising:

a pair of elongated vertical stiles made of steel, each said stile being channel-shaped and including a swaged end portion, an unswaged end portion, and two legs, each said leg of each said stile being divided into inner and outer sections, with each said inner section being offset along its full length from a respective said outer section a distance approximately the thickness of the steel and being shorter in length than said outer section;

a pair of elongated horizontal rails made of steel, each said rail being channel-shaped and including a swaged end portion, an unswaged end portion, and two legs, each said leg of each said rail being divided into inner and outer sections, with each said inner section being offset along its full length from a respective said outer section a distance approximately the thickness of the steel and being shorter in length than said outer section;

each said stile being joined to an adjacent said rail with said swaged end portion of each said stile being received within a respective said unswaged end portion of an adjacent said rail and each said rail being joined to an adjacent said stile with said swaged end portion of each said rail being received within a respective said unswaged end portion of an adjacent said stile to provide a rectangular frame;

a core having inner and outer faces positioned within said legs of each said stile and each said rail and extending between said stiles and said rails;

means for securing said core to said legs of each said stile and each said rail;

a pair of skins; and means for securing one of said skins to one of said offset inner sections of each said stile and to one of said offset inner sections of each said rail and to said inner face of said core and the other of said skins to the other of said offset inner sections of each said stile and to the other of said offset inner sections of each said rail and to said outer face of said core.

2. The rectangular door of claim 1 wherein each said stile and each said rail further includes a back portion.

3. The rectangular door of claim 2 further including a tab extending from said back portion of each said stile for positioning under said back portion of a respective said rail.

4. The rectangular door of claim 3 further including a tab extending from said back portion of each said rail for positioning under said back portion of a respective said stile.

5. The rectangular door of claim 4 wherein each said skin is made of metal and includes a turned under hem around its perimeter for positioning within spaces defined by said outer sections of said legs of said stiles and rails.

6. The rectangular door of claim 5 wherein each said hem has an outer periphery and wherein said outer periphery of each said hem leaves in the order of one-eighth inch of each said outer section of each said leg of each said stile and each said rail exposed on the inner and outer faces of the door to define a border around the door.

7. The rectangular door of claim 1 wherein said core is made of a foam material.

8. The rectangular door of claim 7 wherein said foam core includes at least one reinforcement insert therein for attachment of hardware.

9. The rectangular door of claim 1 wherein each said skin is made of metal.

10. The rectangular door of claim 1 wherein each said skin of a rigid plastic material.

11. The rectangular door of claim 8 wherein each said swaged end portion and each said unswaged end portion of each said stile and each said rail is cut at a forty-five (45°) angle.

12. A rectangular door having inner and outer faces, said door comprising:

a pair of elongated vertical stiles made of steel, each said stile being channel-shaped and including a swaged end portion cut at a forty-five (45°) angle, an unswaged end portion cut at a forty-five (45°) angle, and two legs, each said leg of each said stile being divided into inner and outer sections, with each said inner section being offset along its full length from a respective said outer section a distance approximately the thickness of the steel;

a pair of elongated horizontal rails made of steel, each said rail being channel-shaped and including a swaged end portion cut at a forty-five (45°) angle, an unswaged end portion cut at a forty-five (45°) angle, and two legs, each said leg of each said rail being divided into inner and outer sections, with each said inner section being offset along its full length from a respective said outer section a distance approximately the thickness of the steel;

each said stile being joined to an adjacent said rail with said swaged end portion of each said stile being received within a respective said unswaged end portion of an adjacent said rail and each said rail being joined to an adjacent said stile with said swaged end portion of each said rail being received within a respective said unswaged end portion of an adjacent said stile to provide a rectangular frame;

a core having inner and outer faces positioned within said legs of each said stile and each said rail and extending between said stiles and said rails;

means for securing said core to said legs of each said stile and each said rail;

a pair of skins; and means for securing one of said skins to one of said offset inner sections of each said stile and to one of said offset inner sections of each said rail and to said inner face of said core, and the other of said skins to the other of said offset inner sections of each said stile and to the other of said offset inner sections of each said rail and to said outer face of said core.

13. The rectangular door of claim 12 wherein each said stile and each said rail further includes a back portion.

14. The rectangular door of claim 13 wherein each said swaged end portion of each said stile includes a flap and each said back portion of each said stile includes a tab extending therefrom for positioning within said unswaged end portion of an adjacent rail.

15. The rectangular door of claim 14 wherein each said swaged end portion of each said rail includes a flap and each said back portion of each said rail includes a tab extending therefrom for positioning within said unswaged end portion of an adjacent stile.

16. The rectangular door of claim 15 wherein each said skin is made of metal and includes a turned under hem around its perimeter for positioning within spaces defined-by said outer sections of said legs of said stiles and rails.

17. The rectangular door of claim 16 wherein said core is made of a foam material and wherein said perimeter of each said hem leaves in the order of one-eighth inch of each said outer section of each said leg of each said stile and each said rail exposed on the inner and outer faces of the door to define a border around the door.

* * * * *